US005753177A

United States Patent [19]

Morinaga et al.

[11] Patent Number: 5,753,177

[45] Date of Patent: May 19, 1998

[54] HIGH-NI AUSTENITIC STAINLESS STEEL HAVING EXCELLENT HIGH-TEMPERATURE STRENGTH

[75] Inventors: Masahiko Morinaga; Yoshinori Murata, both of Toyohashi; Shigeharu Ukai; Sakae Shikakura, both of Mito; Makoto Harada, Koobe; Toshio Nishida, Higashiibaraki-gun, all of Japan

[73] Assignees: Doryokuro Kakunenryo Kaihatsu Jigyodan, Tokyo; Toyohashi University of Technology, Aichi, both of Japan

[21] Appl. No.: 522,662

[22] Filed: Sep. 1, 1995

Related U.S. Application Data

[63] Continuation-in-part of Ser. No. 302,967, Sep. 12, 1994, abandoned.

[30] Foreign Application Priority Data

Mar. 10, 1994 [JP] Japan ..... 6-039391

[51] Int. Cl.[6] ..... C22C 38/44; C22C 30/00; C22C 19/05

[52] U.S. Cl. ..... 420/53; 420/586.1; 420/453

[58] Field of Search ..... 420/53, 453, 586.1; 148/410, 442, 427, 327

[56] References Cited

U.S. PATENT DOCUMENTS

| | | |
|---|---|---|
| 4,158,606 | 6/1979 | Bloom et al. . |
| 4,861,547 | 8/1989 | Culling . |
| 4,981,647 | 1/1991 | Rothman et al. . |

FOREIGN PATENT DOCUMENTS

| | | |
|---|---|---|
| B2-58-56024 | 12/1983 | Japan . |
| A-62-217190 | 9/1987 | Japan . |
| B2-1-42346 | 9/1989 | Japan . |
| A-3-229840 | 10/1991 | Japan . |

*Primary Examiner*—Deborah Yee
*Attorney, Agent, or Firm*—Oliff & Berridge, P.L.C.

[57] ABSTRACT

A high-Ni austenitic stainless steel having swelling resistance, high-temperature creep strength, and phase stability under irradiation. The irradiation resistance and high-temperature strength of the high-Ni austenitic stainless steel are enhanced when it is composed of the following percentages by weight: Si, not exceeding 0.5 wt. %; Mn, not exceeding 1.0 wt. %; Cr, 13–18 wt. %; Ni, 30–50 wt. %; Mo+W=2.0–6.0 wt. %; Nb+V=0.1–0.8 wt. % (Nb/(Nb+V) [weight ratio]=0.20–0.85 [weight ratio]; N, 0.01–0.2 wt. %; and the residual consisting of Fe and unavoidable impurities.

9 Claims, 6 Drawing Sheets

CREEP RUPTURE CHARACTERISTICS

RESULT OF CREEP RUPTURE TEST

COMPARISON OF CREEP RUPTURE STRENGTH

TENSILE ELONGATION OF SAMPLE MATERIAL (%)

| | 700°C-1000h CREEP RUPTURE STRENGTH (MPa) | COMPARATIVE STEEL OR INVENTIVE STEEL |
|---|---|---|
| A | 192 | COMPARATIVE STEEL |
| B | 193 | COMPARATIVE STEEL |
| C | 193 | COMPARATIVE STEEL |
| D | 198 | COMPARATIVE STEEL |
| E | 198 | COMPARATIVE STEEL |
| F | 185 | COMPARATIVE STEEL |
| G | 183 | COMPARATIVE STEEL |
| H | 176 | COMPARATIVE STEEL |
| I | 226 | INVENTIVE STEEL |
| J | 182 | COMPARATIVE STEEL |
| CN2 | 193 | INVENTIVE STEEL |
| CN6 | 208 | INVENTIVE STEEL |
| P201 | 209 | INVENTIVE STEEL |
| P202 | 223 | INVENTIVE STEEL |
| P203 | 249 | INVENTIVE STEEL |
| P204 | 234 | INVENTIVE STEEL |
| P205 | 191 | INVENTIVE STEEL |
| P206 | 239 | INVENTIVE STEEL |
| P207 | 211 | INVENTIVE STEEL |
| P208 | 165 | COMPARATIVE STEEL |
| P209 | 235 | INVENTIVE STEEL |
| P210 | 185 | INVENTIVE STEEL |

FIG.6B

HIGH-NI AUSTENITIC STAINLESS STEEL HAVING EXCELLENT HIGH-TEMPERATURE STRENGTH

This application is a continuation-in-part of application Ser. No. 08/302,967, filed Sep. 12, 1994, now abandoned.

BACKGROUND OF THE INVENTION

1. Field of the Invention

The present invention relates to a structural member requiring a certain neutron-irradiation resistance, such as, for example, core components (e.g. a fuel assembly including fuel cladding tubes and wrapper tubes, a control rod, and a reflector etc.) and equipment structures (e.g. equipment container members, piping members for cooling system) that are used for long periods of time under core environment conditions of an atomic reactor, especially a fast breeder reactor.

2. Description of the Related Art

As a material for core structural members of an atomic reactor, SUS 316 or an improved version thereof has generally been used heretofore. For example, it is known that increasing the Ni-content is an effective method for improving the irradiation resistance of SUS 316. A high-Ni version of SUS 316 has been used for this purpose. According to conventional irradiation test results on a Fe—Cr—Ni type alloy, it is recognized that the void swelling depends on the composition of Ni. For example, in a Fe-15 Cr alloy the swelling amount becomes minimum when the wt. % of Ni is 45%. Table 1 illustrates results of a Ni ion irradiation test carried out for examining swelling resistance of a conventional stainless steel and a high-Ni stainless steel. As shown in Table 1, the swelling amount reduces as the Ni amount increases. Also, 15 Cr-40 Ni stainless steel has a better swelling resistance than PNC 316.

as disclosed in Japanese Patent Laid-Open No. Sho 62-217190. In this manner, according to the conventional art, the high-temperature strength is improved by the single addition of Nb or V, or the complex addition of V, Ti and Cu etc.

In view of the economy of the fast breeder reactor, however, greater swelling resistance and high-temperature strength are required than previously necessary. If the aforementioned strengthening is carried out using only carbides (as described in Japanese Patent Publication No. Sho 58-56024), it is not possible to obtain a sufficient creep strength at temperatures greater than 650° C.

If the aforementioned strengthening is carried out using only nitrides of Nb (as described in Japanese Patent Application Hei 2-25622), then due to the low solid solubility of N with regard to Ni, when the content of Ni is increased to improve the swelling resistance, the solid solubility of the nitrides is reduced. As a result, the high-temperature strength is disadvantageously lowered. In this case, it is necessary to enhance the solution heat treatment temperature to increase the solid solubility amount of the carbides and nitrides. This method is not realistic because a heat treatment exceeding 1150° C. is difficult to execute in presently used facilities. Moreover, if the solution heat treatment is carried out coercively at a high temperature to increase the solid solubility amount of the carbides and nitrides, the size of the crystal grains becomes too large to allow ultrasonic inspection.

Furthermore, despite its effectiveness as a strengthening element, N reacts with neutrons to produce He so as to cause problems of swelling and embrittlement.

A core material of a nuclear reactor chiefly focusing on the high-temperature strength is disclosed in Japanese Patent Publication No. Hei 1-42346. This material has disadvantages in the swelling resistance and the phase stability due to neutron irradiation.

TABLE 1

RESULT OF Ni ION ILLUMINATION TEST

| | IRRADIATION CONDITIONS & SWELLING MEASUREMENT-RESULT | | | | |
|---|---|---|---|---|---|
| SAMPLE | dose (dpa) | VOID DENSITY ($\times 10^{20}$ $m^{-3}$) | VOID DIAMETER (nm) | SWELLING (%) | MICRO STRUCTURE OBSERVATION RESULT |
| PNC316 | 160 | 10.9 | 56.5 | 11.5 | MANY VOIDS, PRECIPITATION |
| 15Cr—20Ni | 120 | 6.4 | 66.7 | 11.0 | MANY VOIDS |
| | 160 | 7.2 | 70.1 | 14.9 | MANY VOIDS<br>LARGER GRAIN DIAMETER AT DISLOCATION BAND<br>SMALLER VOID DIAMETER NEAR GRAIN BOUNDARY |
| 15Cr-25Ni | 160 | 1.0 | 63.5 | 1.35 | MEDIUM NUMBER OF VOIDS |
| D | 160 | 2.1 | 43.9 | 0.95 | LESS NUMBER OF VOIDS MODULATED STRUCTURE |
| NOTES | PNC316: 16Cr—14Ni<br>D: 15Cr—40Ni | | | | |

When the Ni content of SUS 316 is increased, the high-temperature strength of SUS 316 is reduced. Therefore, it is understood that this type of high-Ni improved stainless steel is undesirable for the long life core components.

To cope with such disadvantages, the strength and the swelling resistance can be combined together to a certain extent by adding carbides such as V, Nb, Ti and Zr to the high-Ni austenitic stainless steel, as described in Japanese Patent Publication No. Sho 58-56024. It is also known to ensure the high-temperature strength by precipitation strengthening using nitrides of Nb, as disclosed in Japanese Patent Application No. Hei 2-25622, or using V, Ti and Cu,

SUMMARY OF THE INVENTION

It is therefore an object of this invention to overcome the above problems by providing a high-Ni austenitic stainless steel having both swelling resistance, and high-temperature creep strength and phase stability under irradiation.

This and other objects of the invention are achieved by providing a high-Ni austenitic stainless steel that contains: mainly Fe—Cr—Ni type alloy; Mo and W as a solid solution strengthening element; and complex addition of Nb and V and single addition of N, or complex addition N and C as precipitation strengthening elements of carbides and nitrides. The high-Ni austenitic stainless steel of this invention has excellent irradiation resistance. In particular, according to this invention, a better synergistic effect can be obtained by using Nb and V than when using each of them separately.

The present invention has been achieved by profoundly studying the phase stability and the high-temperature strength on the basis of the d-Electrons alloy design theory (Japanese Patent Laid-Open No. Hei 2-25622), and out of pile testing.

The present invention will become clear from the following description of the preferred embodiment thereof, taken in conjunction with the accompanying drawings.

BRIEF DESCRIPTION OF THE DRAWINGS

The invention will be described in conjunction with the following drawings wherein:

FIG. 6B is a table illustrating creep rupture strengths of steels according to this invention and creep rupture strengths of comparative steels.

DETAILED DESCRIPTION OF PREFERRED EMBODIMENTS

Figure 1:
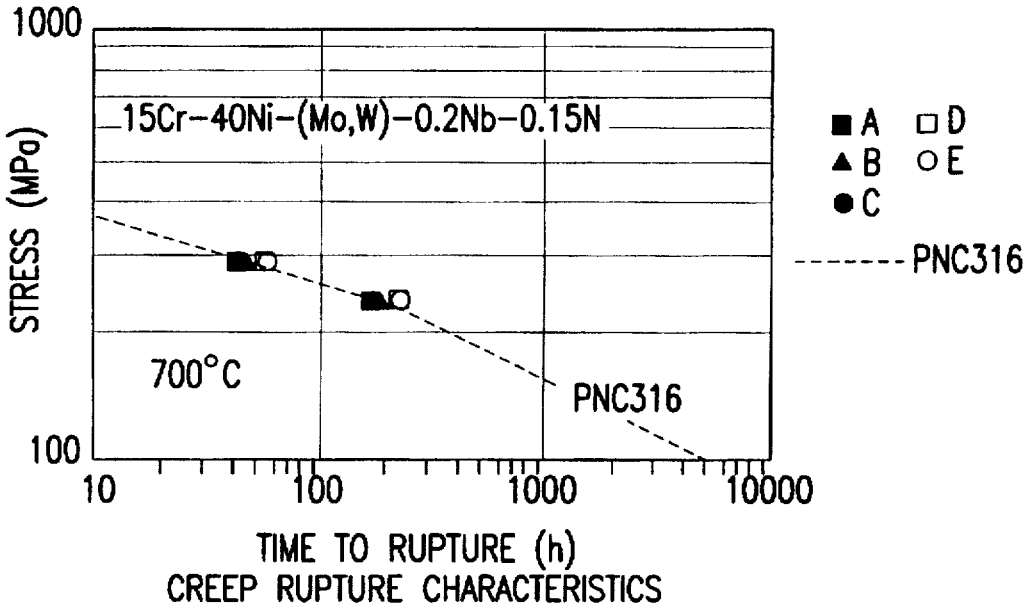
FIG. 1 is a diagram illustrating the effect of the amount of Mo and W in comparison of PNC 316 stainless steel to high-Ni stainless steel.

A high-Ni austenitic stainless steel according to a first aspect of this invention contains in weight %: Si, not exceeding 0.5 wt. %; Mn, not exceeding 1.0 wt. %; Cr, 13–18 wt. %; Ni, 30–50 wt. %; Mo+W, 2.0–6.0 wt. %; Nb+V, 0.1–0.8 wt. % ((Nb/(Nb+V) [weight ratio]=0.20–0.85 [weight ratio]); N, 0.01–0.2 wt. %; with the residual being made up of Fe and unavoidable impurities.

In a second aspect of the high-Ni austenitic stainless steel of this invention, a part of N (0–81%) of the high-Ni austenitic stainless steel according to the first aspect of this invention is substituted by C.

In a third aspect of the high-Ni austenitic stainless steel of this invention, less than 0.08 wt. % of P is added to the high-Ni austenitic stainless steel according to the first or the second aspect of this invention.

In a fourth aspect of the high-Ni austenitic stainless steel of this invention, less than 0.01 wt. % of B is added to the high-Ni austenitic stainless steel according to any of the first, second and third aspects of this invention.

In the aforementioned kinds of high-Ni austenitic stainless steel, Ni is an austenite-stabilizing element and an important element for improving the swelling resistance. The Ni content should be at least 30 wt. %. If it exceeds 50 wt. %, however, the residual radiation due to the irradiation becomes extremely high causing waste-management and reprocessing problems. The anti-sodium corrosion characteristics will also be lowered. Further, Ni reacts with neutrons to generate He causing He embrittlement. Therefore, the Ni amount should be between 30–50 wt. %.

Mo and W are important solid solution strengthening elements, and are required to be added at not less than 2.0 wt. % of the total amount. If the content of Mo and W exceeds 6.0 wt. %, however, the neutron-absorptive cross-section becomes too large to maintain desired breeding characteristics. In addition, an excessive addition of Mo and W would result in μ phase ($Fe_7(MO, W)_6$) lowering ductility. Accordingly, the amount of Mo and W should be 2.0 wt. %–6.0 wt. %.

Nb and V constitute carbides and nitrides and are important precipitation strengthening elements. Nb and V, when the addition is complex, act to make a fine precipitate and increase the high-temperature strength. Therefore, the summed amount of Nb and V (i.e., Nb+V) should be at least 0.1 wt. % for precipitation strengthening. Addition of 0.8 wt. % or more of (Nb+V) will produce non-solid soluble compounds that lower the ductility. Accordingly, the amount of (Nb+V) must be 0.1–0.8 wt. %. Referring to FIG. 6, V and Nb have an advantage of complex addition strengthening so long as they are in a weight ratio of Nb/(B+Nb)=0.20 to 0.85. Outside this range, the complex addition is not advantageous.

N and C constitute carbides and nitrides by combining with Nb and V and are important for enhancing the high-temperature strength. Even N alone sufficiently can contribute to improve the high-temperature strength in an amount of just 0.01 wt. %. If 0.20 wt. % or more of N is added, however, a non-solid soluble nitride will form lowering the ductility. The N contact should not exceed 0.20 wt. %.

Accordingly, the N amount should be 0.01–0.20 wt. %. Meanwhile, C solely does not sufficiently contribute to enhance the high-temperature strength, but reacts with the neutrons to produce He causing He embrittlement. Therefore, a part of N should preferably be substituted by C. The change of the C/N ratio is not so intimately related to the strength, but when C/N [atom ratio]=5/1 or more, the carbide and nitrides are too large to maintain the strength. Accordingly, the adding ratio of C and N should be C/N [atom ratio]=0–5/1 (C/(C+N)=0–81 wt. %). Thus, even a part of N is converted into C (by nuclear reaction) which does not solely enhance the high-temperature strength, the high-temperature strength is almost the same as in the case of sole N.

It is well known that S is a harmful element that tends to gather in grain boundaries forming a fusible eutectic. This weakens the steel. Since 0.005 wt. % or less of S does not demonstrate the foregoing disadvantages, the S content should preferably be equal to or less than 0.005 wt. %.

The addition of P is effective for improving swelling resistance, while the addition of B is effective for making a fine precipitate. These are also added in the PNC 316 stainless steel, which is an improvement of SUS 316 used in the fuel cladding tube of the FBR nuclear reactor "Monju". The addition of P of less than 0.08 wt. % and B of less than 0.01 wt. % are effective in such types of high-Ni austenitic stainless steel and constitute a part of the present invention. An addition of P exceeding 0.08 wt. % would undesirably affect the welding characteristics, while the addition of B exceeding 0.01 wt. % would undesirably affect the neutron economy, so that these values are established in this invention as the upper limits.

In addition, it is known that the swelling resistance can be improved during manufacture by finishing by cold working. In PNC 316, approximately 20% of cold working is applied. Cold working of 30% or more will lower the creep strength.

Cold working is effective for the high-Ni austenitic stainless steel according to this invention, and finishing with cold working of less than 30% is included within the scope of the present invention.

Alternatively, Si can also be added as a deoxidant. If the Si amount exceeds 0.5 wt. %, however, toxic inter-metallic compounds would easily precipitate during the irradiation, so as to cause embrittlement. Therefore, the adding amount of Si must not exceed 0.5 wt. %.

Mn is effective for improving the hot working characteristics and stabilizing the austenitic structure. Mn forms a hardened phase when exceeding 1.0 wt. % that lowers the toughness and machinability. Mn should not exceed 1.0 wt. %.

Cr is indispensable for improving sodium corrosion characteristics and the decarbonizing resistance. For this purpose, an amount of 13 wt. % or more of Cr is required. If it exceeds 18 wt. %, however, not only does the swelling-resistance reduce, but the metallurgical structure becomes unstable and toxic inter-metallic compounds are easily precipitated (especially, under the neutron irradiation, grain boundary precipitation embrittlement easily arises due to the phase instability). Therefore, the Cr amount should be restricted to 13 wt. %–18 wt. %.

A test material has been manufactured in the following manner. A plate with a thickness of 20 mm is made in a vacuum induction furnace with a soaking treatment (1200° C.×20 h), hot forging, hot rolling, and annealing (1100° C.×1hWQ). The crystal grain size is adjusted by 55% cold rolling, and a solution heat treatment (1080–1120° C. ×1hWQ) to produce a plate of 9*t*. Finally, cold working of 20% is applied to the plate to finish the specimen. The compositions of the specimens are shown in the Tables 2, 3 and 4.

TABLE 2

COMPOSITIONS OF SAMPLE MATERIAL

| | | C | Si | Mn | P | S | Ni | Cr | Mo | W | Nb | Al | N | O |
|---|---|---|---|---|---|---|---|---|---|---|---|---|---|---|
| A | COMPARATIVE STAINLESS STEEL | 0.011 | 0.027 | 0.12 | <.005 | 0.0018 | 39.51 | 14.88 | 1.53 | 1.49 | 0.20 | 0.002 | 0.101 | 0.0060 |
| B | COMPARATIVE STAINLESS STEEL | 0.010 | 0.022 | 0.12 | <.005 | 0.002 | 40.43 | 15.07 | 2.07 | 2.03 | 0.21 | <.001 | 0.095 | 0.0018 |
| C | COMPARATIVE STAINLESS STEEL | 0.011 | 0.022 | 0.12 | <.005 | 0.002 | 40.08 | 15.11 | 2.29 | 2.28 | 0.21 | 0.002 | 0.137 | 0.0057 |
| D | COMPARATIVE STAINLESS STEEL | 0.011 | 0.022 | 0.12 | <.005 | 0.0019 | 39.99 | 15.22 | 2.54 | 2.53 | 0.21 | <.001 | 0.100 | 0.0071 |
| E | COMPARATIVE STAINLESS STEEL | 0.010 | 0.022 | 0.12 | <.005 | 0.0018 | 40.08 | 15.10 | 3.06 | 3.02 | 0.21 | 0.001 | 0.094 | 0.0082 |
| NOTE | | UNIT: wt.% | | | | | | | | | | | | |

TABLE 3

COMPOSITIONS OF TEST MATERIAL

| | | C | Si | Mn | P | S | Ni | Cr | Mo | W | Nb | V | Al | N | O |
|---|---|---|---|---|---|---|---|---|---|---|---|---|---|---|---|
| F | COMPARATIVE STAINLESS STEEL | 0.011 | 0.015 | 0.13 | <.005 | 0.0014 | 41.53 | 15.22 | 2.34 | 2.34 | 0.11 | 0.005 | 0.002 | 0.101 | 0.0060 |
| G | COMPARATIVE STAINLESS STEEL | 0.010 | 0.014 | 0.12 | <.005 | 0.0011 | 41.12 | 15.08 | 2.29 | 2.30 | 0.21 | 0.005 | <.001 | 0.095 | 0.0078 |
| H | COMPARATIVE STAINLESS STEEL | 0.010 | 0.026 | 0.13 | <.005 | 0.0012 | 41.38 | 15.15 | 2.33 | 2.32 | 0.11 | 0.009 | 0.002 | 0.137 | 0.0057 |
| I | INVENTIVE STAINLESS STEEL | 0.011 | 0.018 | 0.12 | <.005 | 0.0018 | 40.98 | 15.11 | 2.30 | 2.30 | 0.11 | 0.11 | <.001 | 0.100 | 0.0071 |
| J | COMPARATIVE STAINLESS STEEL | 0.011 | 0.018 | 0.12 | <.005 | 0.0018 | 41.51 | 15.22 | 2.32 | 2.32 | 0.004 | 0.21 | 0.001 | 0.094 | 0.0082 |
| NOTE | | UNIT: wt % | | | | | | | | | | | | | |

TABLE 4

COMPOSITIONS OF TEST MATERIAL

| | | C | Si | Mn | P | S | Ni | Cr | Mo | W | Nb | V | Ti | N | Al |
|---|---|---|---|---|---|---|---|---|---|---|---|---|---|---|---|
| CN2 | INVENTIVE STAINLESS STEEL | 0.010 | 0.034 | 0.11 | 0.005 | 0.0013 | 40.35 | 15.53 | 1.91 | 1.95 | 0.22 | 0.42 | — | 0.110 | <.005 |
| CN4 | COMPARATIVE STAINLESS STEEL | 0.010 | 0.036 | 0.11 | 0.005 | 0.0013 | 39.82 | 15.25 | 1.89 | 1.92 | — | 0.42 | 0.087 | 0.111 | <.005 |
| CN5 | COMPARATIVE STAINLESS STEEL | 0.010 | 0.036 | 0.11 | 0.005 | 0.0015 | 39.93 | 15.35 | 1.89 | 1.94 | 0.23 | 0.37 | 0.043 | 0.109 | <.005 |
| CN6 | INVENTIVE STAINLESS STEEL | 0.041 | 0.025 | 0.11 | 0.005 | 0.0016 | 40.18 | 15.41 | 1.89 | 1.95 | 0.22 | 0.34 | — | 0.064 | <.005 |
| NOTE | | UNIT: wt. % | | | | | | | | | | | | | |

The characteristics of the high-Ni austenitic stainless steel according to the present invention will be inspected. FIG. 1 (the composition is shown in Table 2) illustrates the examined dependency of the amount of Mo and W as solid solution strengthening elements in the comparative member (conventional stainless steel). As shown in FIG. 1, when Nb is solely added, there is already a saturation when Mo+W=3 wt. % or more is added, and the creep rupture strength corresponding to the high-temperature strength is already nearly the same as that of PNC 316 (an improved stainless steel of SUS 316 and used for the fuel cladding tube of the FBR "Monju"). In this manner, though no remarkable effect can be obtained solely by the addition of Nb, for the purpose of manufacturing a material having at least the same level as PNC 316, it has been determined that the summed amount of Mo and W (Mo+W) is sufficient at 2–6 wt. %, and the experiment noted below was conducted.

Figure 2:
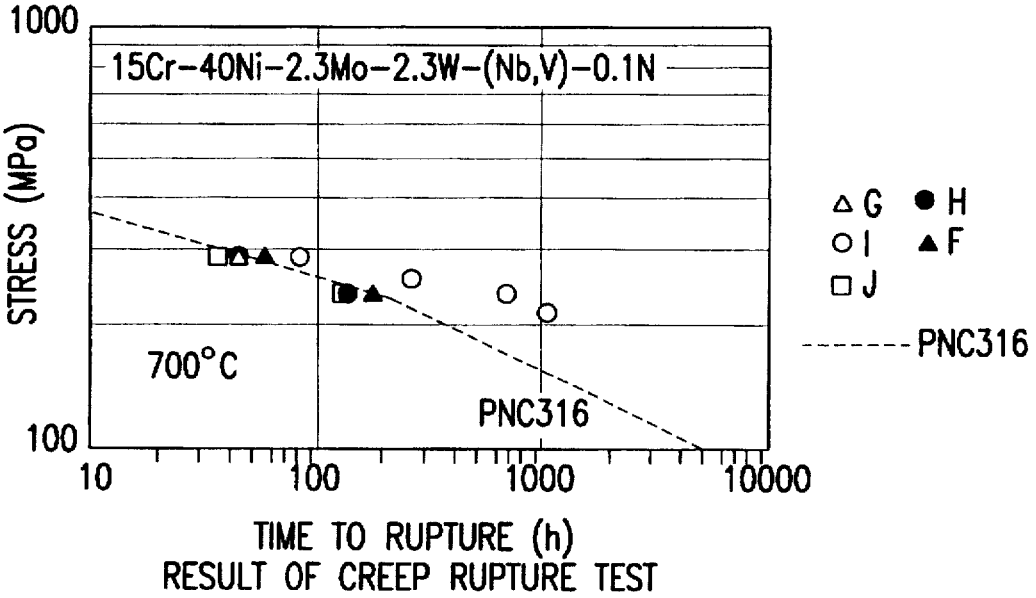
FIG. 2 is a diagram illustrating that complex addition of V and Nb renders a higher effect of enhancing the high-temperature creep strength than the separate addition of V and Nb.

FIG. 2 (the composition is shown in Table 3) shows a result of a comparison of the sole addition of V and Nb and complex addition. As shown in FIG. 2, while the creep rupture strength is nearly the same as the PNC 316 in the case of sole addition, that of the complex addition has a strength 5–8 times higher than that. This could be considered to be a result of the carbides and nitrides being refined by the complex addition.

In this case, in the aforementioned test materials A–J, C is intentionally not added to the comparative stainless steel or to the inventive stainless steel (namely, C is an unavoidable composition having been originally contained in the steel).

Figure 3:
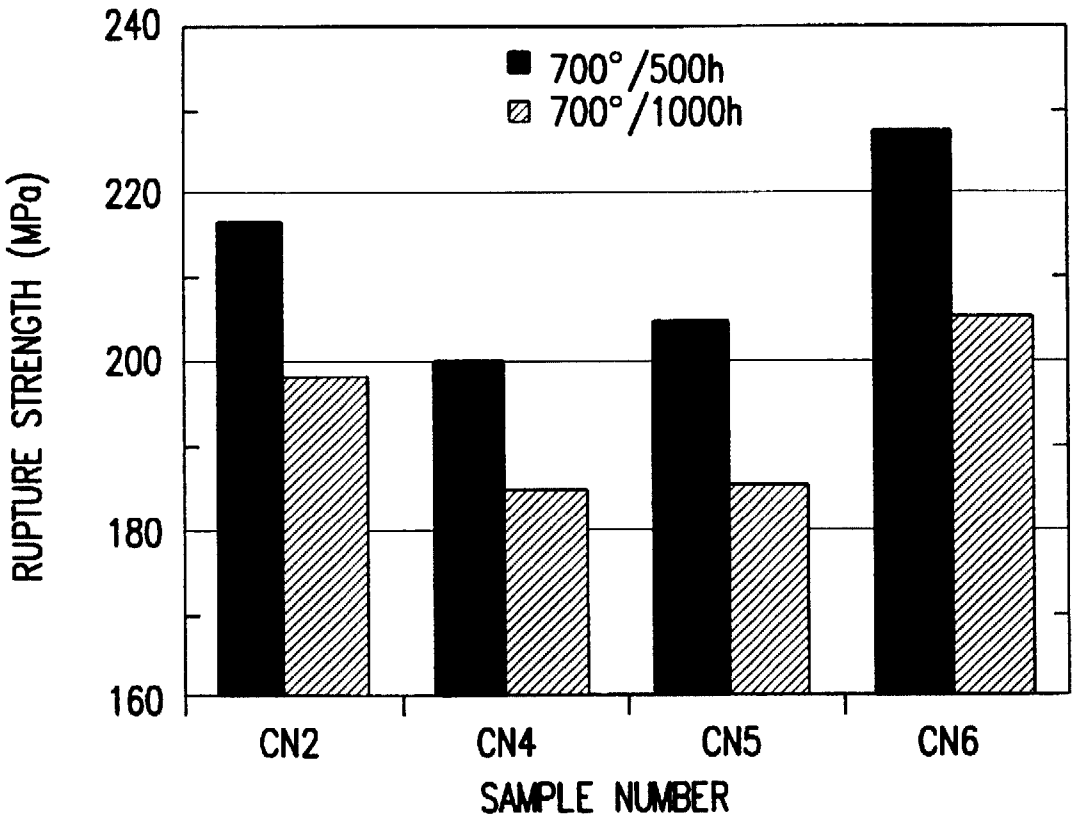
FIG. 3 is a diagram illustrating that high-Ni stainless steel with a part of N being substituted by a complex addition of V and Nb and C has an excellent high-temperature strength.

In contrast to a sole solid solubility of N, in the solutions it is possible to convert part of N while maintaining the characteristics of the stainless steel. FIG. 3 illustrates the results of a comparison between a material having solely N added, and a material with a part of N being converted into C, in a complex addition of Nb and V. The composition of the specimen shown in FIG. 3 is as shown in Table 4. In CN 6, a part of N of CN2 is converted into C. The amounts of the other components in CN6 differ from CN2 because the C-converting operation affected the other components. In FIG. 3, by comparing CN 6 to CN 2, it is seen that the strength is constant even when a part of N is converted into C. CN 6 and CN 2 have better strengths than that of PNC 316. From FIG. 3, it is clear that the comparative stainless steels (CN4, CN5) with a complex addition of Ti-V in CN4 and a complex addition of Ti, V and Nb in CN5 are less advantageous than the stainless steel according to this invention because of their lower high-temperature strength than the complex added material of Nb and V. As a result, a particular effect can be rendered by the complex addition of V and Nb.

In a second embodiment, alloy design parameters affecting the high-temperature strength have been examined. Table 5 illustrates alloy design parameters of a sample test material, while Table 6 illustrates composition analysis results of a specimen having been actually manufactured as a sample.

TABLE 5

ALLOY DESIGN PARAMETER OF TEST MATERIAL

| | C/N | (V + Nb)/C + N) | V/Nb | OTHERS |
|---|---|---|---|---|
| P201 | 3.04 (3.0) | 1.10 (1.0) | 3.00 (3.0) | BASIC COMPOSITION |
| P202 | 1.02 (1.0) | 0.99 (1.0) | 3.00 (3.0) | C/N = 1 |
| P203 | 0.28 (0.33) | 0.90 (1.0) | 3.00 (3.0) | C/N = 1/3 |
| P204 | 4.16 (3.0) | 1.58 (1.5) | 2.99 (3.0) | (V + Nb)/(C + N) = 1.50 |
| P205 | 3.17 (3.0) | 0.53 (0.5) | 2.55 (3.0) | (V + Nb)/(C + N) = 0.50 |
| P206 | 3.19 (3.0) | 0.98 (1.0) | 0.97 (1.0) | V/Nb = 1 |
| P207 | 3.82 (3.0) | 1.02 (1.0) | 2.99 (3.0) | C + N = 0.60 at. % |
| P208 | 2.94 (3.0) | 1.00 (1.0) | 3.08 (3.0) | (Mo, W) = (0.85 wt %, 0.65 wt %) |
| P209 | 3.28 (3.0) | 1.02 (1.0) | 0.34 (0.33) | V/Nb = 1/3 |
| P210 | 1.94 (2.0) | 0.93 (1.0) | 3.08 (3.0) | |

NOTES ANALYZED VALUE (TARGET VALUE)
15Cr—35Ni—2.5Mo—1.6W—V—Nb—C—N (wt %)
BASIC CONDITIONS: (Mo, W) = (0.5 at %, 1.5 at %), C + N = 0.4 at %, (V/Nb, C/N, [V + Nb]/[C + N]) = (SAME AS P201)

TABLE 6

COMPOSITIONS (ANALYZED VALUE)

| | | C | Si | Mn | P | S | Ni | Cr | Mo | W | B | N | Nb | V | Fe |
|---|---|---|---|---|---|---|---|---|---|---|---|---|---|---|---|
| P201 | (wt %) | 0.060 | 0.014 | 0.004 | 0.023 | 0.0016 | 35.59 | 15.08 | 2.61 | 1.66 | 0.004 | 0.023 | 0.17 | 0.28 | bal. |
| | (at %) | 0.29 | 0.029 | 0.004 | 0.043 | 0.0029 | 34.76 | 16.62 | 1.56 | 0.52 | 0.021 | 0.094 | 0.10 | 0.32 | bal. |
| P202 | (wt %) | 0.045 | 0.014 | 0.004 | 0.023 | 0.0015 | 35.37 | 14.97 | 2.59 | 1.62 | 0.0041 | 0.0516 | 0.17 | 0.28 | bal. |
| | (at %) | 0.21 | 0.029 | 0.004 | 0.043 | 0.0027 | 34.52 | 16.49 | 1.55 | 0.50 | 0.022 | 0.211 | 0.10 | 0.31 | bal. |
| P203 | (wt %) | 0.021 | 0.018 | 0.120 | 0.023 | 0.0020 | 35.39 | 15.01 | 2.52 | 1.66 | 0.0041 | 0.0890 | 0.17 | 0.28 | bal. |
| | (at %) | 0.10 | 0.037 | 0.125 | 0.043 | 0.0036 | 34.52 | 16.53 | 1.50 | 0.52 | 0.022 | 0.364 | 0.10 | 0.31 | bal. |
| P204 | (wt %) | 0.066 | 0.013 | 0.003 | 0.024 | 0.0016 | 35.45 | 15.08 | 2.61 | 1.66 | 0.0040 | 0.0185 | 0.25 | 0.41 | bal |
| | (at %) | 0.31 | 0.027 | 0.003 | 0.044 | 0.0029 | 34.62 | 16.62 | 1.56 | 0.52 | 0.021 | 0.076 | 0.15 | 0.46 | bal. |
| P205 | (wt %) | 0.066 | 0.010 | 0.003 | 0.023 | 0.0012 | 35.51 | 15.06 | 2.61 | 1.63 | 0.0041 | 0.0243 | 0.10 | 0.14 | bal. |
| | (at %) | 0.31 | 0.020 | 0.003 | 0.043 | 0.0021 | 34.66 | 16.59 | 1.56 | 0.51 | 0.022 | 0.099 | 0.06 | 0.16 | bal. |
| P206 | (wt %) | 0.067 | 0.011 | 0.003 | 0.023 | 0.0014 | 35.55 | 15.11 | 2.61 | 1.63 | 0.0041 | 0.0245 | 0.34 | 0.18 | bal. |

TABLE 6-continued

| | | COMPOSITIONS (ANALYZED VALUE) | | | | | | | | | | | | | |
|---|---|---|---|---|---|---|---|---|---|---|---|---|---|---|---|
| | | C | Si | Mn | P | S | Ni | Cr | Mo | W | B | N | Nb | V | Fe |
| | (at %) | 0.32 | 0.022 | 0.003 | 0.043 | 0.0025 | 34.73 | 16.66 | 1.56 | 0.51 | 0.022 | 0.100 | 0.21 | 0.10 | bal. |
| P207 | (wt %) | 0.100 | 0.014 | 0.004 | 0.023 | 0.0017 | 35.64 | 15.02 | 2.61 | 1.65 | 0.0041 | 0.0305 | 0.25 | 0.41 | bal. |
| | (at %) | 0.48 | 0.029 | 0.004 | 0.042 | 0.0030 | 34.75 | 16.53 | 1.56 | 0.51 | 0.022 | 0.125 | 0.15 | 0.46 | bal. |
| P208 | (wt %) | 0.066 | 0.010 | 0.003 | 0.022 | 0.0015 | 35.47 | 15.18 | 0.86 | 0.70 | 0.0039 | 0.0213 | 0.16 | 0.27 | bal. |
| | (at %) | 0.31 | 0.020 | 0.003 | 0.040 | 0.0026 | 34.14 | 16.49 | 0.51 | 0.22 | 0.020 | 0.086 | 0.10 | 0.30 | bal. |
| P209 | (wt %) | 0.065 | 0.010 | 0.007 | 0.023 | 0.0017 | 35.39 | 14.99 | 2.59 | 1.64 | 0.0041 | 0.0231 | 0.50 | 0.094 | bal. |
| | (at %) | 0.31 | 0.020 | 0.007 | 0.043 | 0.0030 | 34.60 | 16.54 | 1.55 | 0.51 | 0.022 | 0.095 | 0.31 | 0.11 | bal. |
| P210 | (wt %) | 0.060 | 0.011 | 0.004 | 0.024 | 0.0014 | 35.15 | 11.69 | 1.78 | 3.04 | 0.0040 | 0.0361 | 0.16 | 0.17 | bal. |
| | (at %) | 0.29 | 0.023 | 0.004 | 0.045 | 0.0025 | 34.71 | 12.99 | 1.07 | 0.96 | 0.021 | 0.149 | 0.10 | 0.31 | bal. |

15Cr–35Ni type stainless steel, shown in Table 5, has been manufactured as a sample for examining the effect of alloy design parameters (C/N ratio, V/Nb ratio, (V+Nb)/(C+N) ratio etc.) on the high-temperature strength in V, Nb complex added stainless steel. The manufacturing processes are the same as described above. The difference between the alloy design parameters of the test material (Table 5) and the composition of the actually manufactured test material (Table 6) is unavoidable at the present technical level and is within tolerances.

Figure 4:
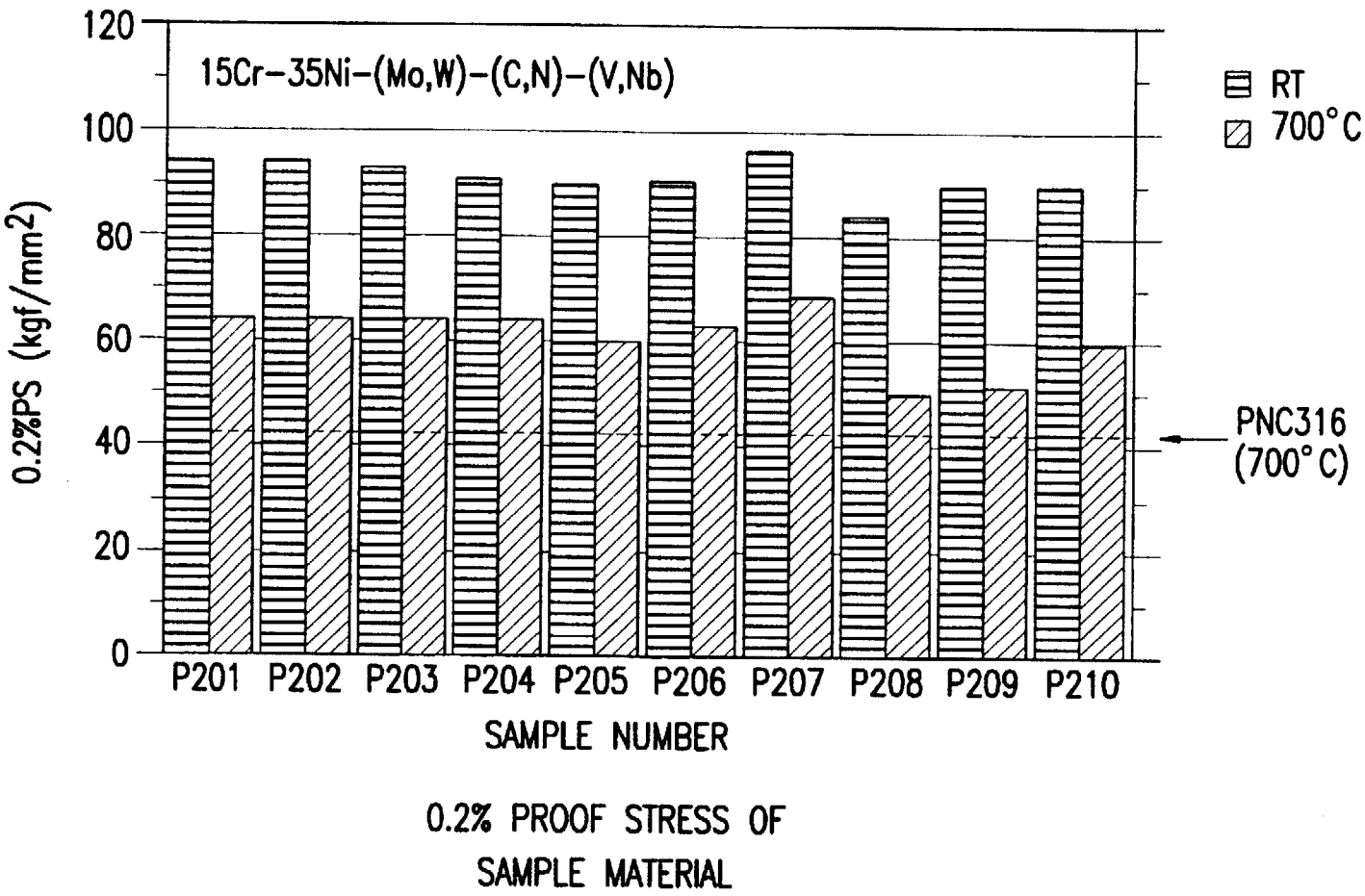
FIG. 4 is a diagram illustrating alloy design parameters such as V/Nb ratio, C/N ratio, (V+Nb)/(C+N) ratio by comparing the results of the tensile test of the material according to this invention at 700° C.

As shown in FIG. 4, the tensile strength of any kind of stainless steel largely exceeds that of PNC 316 and exhibits quite excellent high-temperature strength.

In P201, P206 and P209, the V/Nb ratio is varied from 1/3 to 3/1, but there exists hardly any dependency, so as to sufficiently provide effect of the complex addition in this range. In P201, P202 and P203, the C/N ratio is varied from 1/3 to 3/1, but there is almost no difference between them. When 72% (C/N=3/1 [atom ratio]) of C is converted from N, the effect of the complex addition of V and Nb is sufficiently maintained. The same is true in (V+Nb)/(C+N) in P201, P204 and P205.

Figure 5:
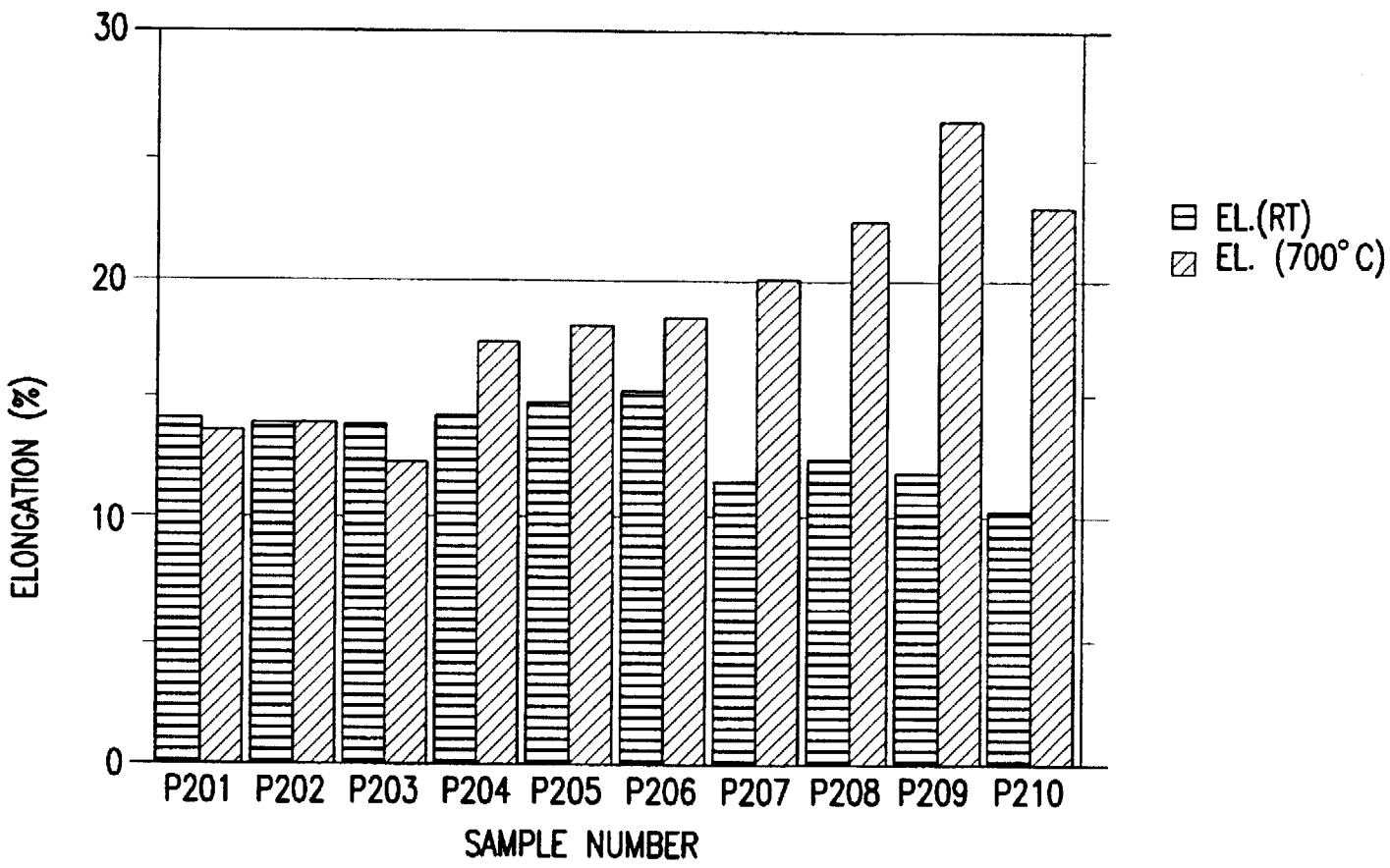
FIG. 5 is a diagram illustrating results of a tensile elongation test at 700° C. for inspecting the ductility of the material according to this invention.

In this case, the high-temperature characteristics of V-Nb complex added stainless steel with respect to the variation of the V/Nb ratio, C/N ratio, (V+Nb)/(C+N) ratio have a little effect vicinity 1/3–3/1. As to the affect of (Mo+W) amount, when 0.86 wt. % Mo and 0.70 wt. % of W in P208 is compared to 2.61 wt. % Mo and 1.66 wt. % of W in P 201, a considerable lowering of the high-temperature strength is seen. In view of this, at least 2.0 wt. % of (Mo+W) will be required. As to the (C+N) amount, when 0.40 at % (atomic %) of P201 and 0.60 at % of P207 are compared to each other, it is understood that 0.60 at % has better high-temperature characteristics and maintains its ductility (FIG. 5). Accordingly, an increase in the amount of (C+N) may further increase the strength, vicinity 0.60 at %.

Figure 6A:
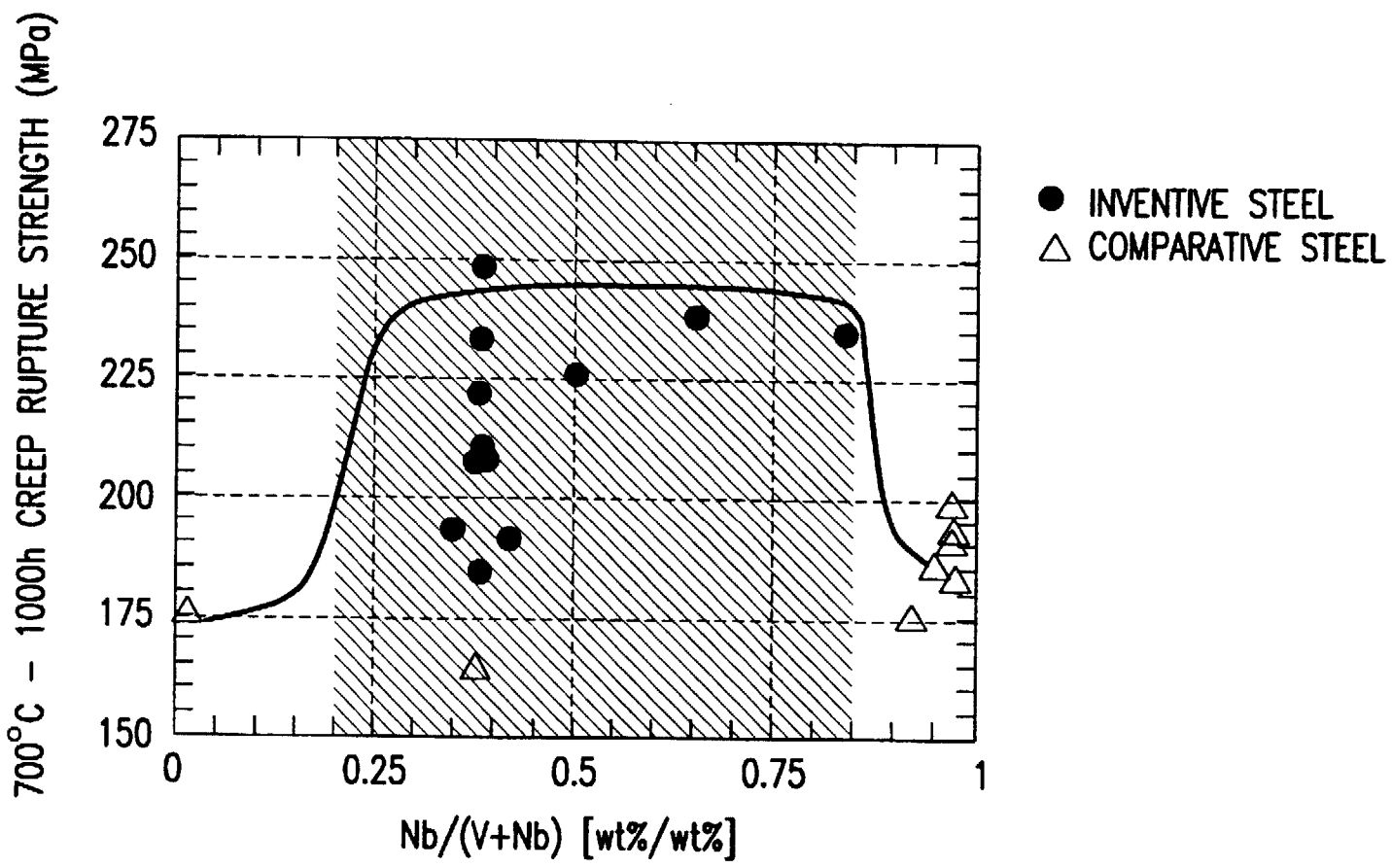
FIG. 6A is a graph illustrating a relationship between Nb (Nb+V) and creep rupture strength obtained by varying Nb/(V+Nb)

Referring to FIG. 6A, creep rupture strengths are variable when Nb/(Nb+V) is approximately 0.37. This is because parameters, such as, C/N ratio and (Nb+V)/(C+N) ratio other than Nb/(Nb+V) are also changed. However, even when such parameters are changed, the stainless steel of the present invention has an excellent creep rupture strength, as shown in FIG. 6B, so long as Nb/(Nb+V) (weight ratio) remains 0.28 to 0.85. P208 is a conventionally used material which has a good creep rupture ratio when Nb/(Nb+V) is approximately 0.37. Further, P208 containing 2 wt. % or less Mo+W is very strong. Therefore, it is possible to quantize effective component ratios in which Nb and V in Ni austenitic steel provide an excellent complex addition when the Ni austenitic steel is applied to the fast breeder reactor. The Ni austenitic steel is remarkably strong when Nb/(Nb+V) is 0.20 to 0.85 in weight ratio. As for the weight ratio of Nb/(Nb+V)=approx. 0.97, since two kinds of data collected in a short time period are added as straight lines, they appear to be large (Refer to FIG. 1).

As mentioned above, according to this invention, a high-Ni austenitic stainless steel having excellent swelling resistance, high-temperature strength and phase stability under neutron irradiation can be provided. This stainless steel can contribute to extend the life of the structure members used in fast breeder reactor members, in particular a structure member such as a fuel cladding tubes used at high temperatures such as 700° C. under high stress conditions.

While this invention has been described in conjunction with specific embodiments thereof, it is evident that many alternatives, modifications and variations will become apparent to those skilled in the art. Accordingly, the preferred embodiments of the invention as set forth herein are intended to be illustrative not limiting. Various changes may be made without departing from the spirit and scope of the invention as defined by the following claims.

What is claimed is:

1. A high-Ni austenitic stainless steel used as a core component of a fast breeder reactor having excellent irradiation resistance and high-temperature strength, comprising: Si, not exceeding 0.5 wt. %; Mn, not exceeding 1.0 wt. %; Cr, 13–18 wt. %; Ni, 30–50 wt. %; Mo+W=2.0–6.0 wt. %; Nb +V=0.1–0.8 wt. %; Nb/(Nb+V) (weight ratio)= 0.20–0.85 [weight ratio]; N, 0.01–0.2 wt. %; and the residual being composed of Fe and unavoidable impurities.

2. A high-Ni austenitic stainless steel according to claim 1, wherein a part of N (0–81%) is substituted by C.

3. A high-Ni austenitic stainless steel according to claim 1, wherein less than 0.08 wt. % of P is added.

4. A high-Ni austenitic stainless steel according to claim 2, wherein less than 0.08 wt. % of P is added.

5. A high-Ni austenitic stainless steel according to claim 1, wherein less than 0.01 wt. % of B is added.

6. A high-Ni austenitic stainless steel according to claim 2, wherein less than 0.01 wt. % of B is added.

7. A high-Ni austenitic stainless steel according to claim 3, wherein less than 0.08 wt. % of B is added.

8. A high-Ni austenitic stainless steel according to claim 4, wherein less than 0.08 wt. % of B is added.

9. A high-Ni austenitic stainless steel according to claim 1, wherein said austenitic stainless steel is finished using less than 30% of cold-working.

* * * * *